US006109272A

United States Patent [19]

Saito et al.

[11] Patent Number: 6,109,272

[45] Date of Patent: Aug. 29, 2000

[54] METHOD FOR PRODUCING A TOBACCO FLAVOR-TASTING ARTICLE

[75] Inventors: Yutaka Saito; Yuriko Anzai, both of Yokohama, Japan

[73] Assignee: Japan Tobacco Inc., Tokyo, Japan

[21] Appl. No.: 09/167,484

[22] Filed: Oct. 7, 1998

[30] Foreign Application Priority Data

Oct. 9, 1997 [JP] Japan ..... 9-277401

[51] Int. Cl.[7] ..... A24B 3/14

[52] U.S. Cl. ..... 131/297; 131/290; 131/356; 131/357; 131/370; 131/374; 131/375; 131/280

[58] Field of Search ..... 131/290, 356, 131/357, 370, 374, 375, 297, 280

[56] References Cited

U.S. PATENT DOCUMENTS

| | | | |
|---|---|---|---|
| 5,143,097 | 9/1992 | Sohn et al. | 131/356 |
| 5,322,076 | 6/1994 | Brinkley et al. | 131/374 |
| 5,377,698 | 1/1995 | Litzinger et al. | 131/370 |
| 5,778,899 | 7/1998 | Saito et al. | 131/352 |
| 5,845,649 | 12/1998 | Saito et al. | 131/352 |

FOREIGN PATENT DOCUMENTS

| | | |
|---|---|---|
| 0691083A1 | 1/1996 | European Pat. Off. . |
| 0691084A1 | 1/1996 | European Pat. Off. . |
| 1517547 | 7/1978 | United Kingdom . |

OTHER PUBLICATIONS

Derwent Publications Ltd., London, GB; AN 1978–92128a, XP002118396 & JP 53 130755A (Nov. 15, 1978).

Derwent Publications Ltd., London GB; AN 1979–01094b, XP002118397 & JP 53 133697A (Nov. 21, 1978).

*Primary Examiner*—James Derrington

*Attorney, Agent, or Firm*—Birch, Stewart, Kolasch & Birch, LLP

[57] ABSTRACT

A tobacco flavor-tasting article is manufactured by preparing a heat-irreversibly coagulated glucan sheet containing a tobacco extract. The glucan sheet is prepared by preparing a sheet-like material from a high viscosity aqueous dispersion containing the extract obtained by an extraction treatment of a leaf tobacco, together with a heat-irreversibly coagulating glucan, and heating the sheet-like material to coagulate the glucan. This sheet is cut or pulverized to prepare a tobacco flavor-generating material. On the other hand, a tobacco flavor-adjusting material is prepared by preparing a sheet-like material from a leaf tobacco fibrous residue, which is the residue after the extraction, and cutting the sheet-like material. These tobacco flavor-generating material and tobacco flavor-adjusting material are used in combination to produce a cigarette-like article.

22 Claims, 2 Drawing Sheets

METHOD FOR PRODUCING A TOBACCO FLAVOR-TASTING ARTICLE

BACKGROUND OF THE INVENTION

The present invention relates to a method for producing a tobacco flavor-tasting article, and more particularly to a method for producing a tobacco flavor-tasting article wherein tobacco flavor can be enjoyed by using a tobacco flavor-generating material other than tobacco materials.

In order to improve tobacco flavor, various flavor-generating materials have been developed. For example, Japanese Patent Application Publication No. 53-12598 discloses that a thermally coagulating polysaccharide mainly composed of β-1,3-glucose bonding is added to tobacco. This publication describes in its Examples that a mixture of curdlan, tobacco powder and the like is moistened with water; this material is formed into a sheet form and is cut; and the resultant cut materials are used to produce a smoking article.

Incidentally, in recent years, a tobacco substitute has been demanded to contain a leaf tobacco extract as a flavor component.

However, the method disclosed in the publication relates to a technique of producing a tobacco flavor-generating material which is different from a tobacco substitute containing a leaf tobacco extract, but which contains a solid tobacco material such as tobacco powder or cuts, as a tobacco flavor component.

PCT International Publications WO95/20329 and WO95/20330 disclose a flavor-generating material wherein a flavor component is held in a heat-irreversibly coagulating glucan such as curdlan. This flavor-generating material has excellent stability for holding the flavor component therein, and readily releases the flavor component upon burning or heating, and does not generate any flavor-interfering materials, such as an unpleasant stimulus, pungent or fibrous odor substances upon burning or heating.

However, these PCT International Publications merely disclose a leaf tobacco extract as an example of a hydrophilic flavor component among many flavor components. A leaf tobacco fibrous residue as an extraction residue is never taken into account.

BRIEF SUMMARY OF THE INVENTION

Therefore, a main object of the present invention is to provide a method for producing a tobacco flavor-tasting article whereby tobacco flavor can be enjoyed, by using a tobacco flavor-generating material, other than tobacco materials, which stably holds and fixes a leaf tobacco extract therein, and a leaf tobacco fibrous residue as a leaf tobacco extraction residue is effectively utilized.

Another object of the present invention is to provide a method for producing a tobacco flavor-tasting article, starting from extracting process of the leaf tobacco, wherein a tobacco flavor-generating material is prepared from the leaf tobacco extract, while a tobacco flavor-adjusting material is prepared from the leaf tobacco fibrous material as the extraction residue, and then they are combined so as to make it possible to design tobacco flavor with high flexibility.

Another object of the present invention is to provide a method for producing a tobacco flavor-tasting article which makes it possible to produce the tobacco flavor-tasting article continuously in a plant at the same site.

According to the present invention, the these objects are accomplished by a method for producing a tobacco flavor-tasting article comprising the stages of:

(a) subjecting a leaf tobacco to an extraction treatment to obtain a tobacco extract, and a leaf tobacco fibrous residue (the extraction residue) that does not substantially contain any tobacco extract, from the leaf tobacco;

(b) preparing a viscous aqueous dispersion that contains the tobacco extract together with heat-irreversibly coagulating glucan, forming the dispersion into a sheet form, heating the resultant sheet to coagulate the glucan in a state wherein the tobacco extract is incorporated within the glucan, thereby preparing heat-irreversibly coagulated glucan sheet containing the tobacco extract;

(c) processing the leaf tobacco fibrous residue into a sheet form, thereby preparing a leaf tobacco fibrous sheet that does not substantially contain the tobacco extract;

(d) cutting or pulverizing the heat-irreversibly coagulated glucan sheet to prepare a tobacco flavor-generating material in a form of cuts or powder;

(e) cutting the leaf tobacco fibrous sheet to prepare a tobacco flavor-adjusting material in the form of cuts; and (f) preparing a cigarette-like article by combinedly using the tobacco flavor-generating material and the tobacco flavor-adjusting material.

In the stage (b), the aqueous dispersion can be prepared by stirring a mixture containing water as a dispersion medium, the leaf tobacco extract or a concentrate thereof, and powder of the heat-irreversibly coagulating glucan, whereby a slurry having an increased viscosity can be prepared.

Preferably in the stage (b), the aqueous dispersion can be prepared by preparing a mixture containing the leaf tobacco extract or a concentrate thereof as a dispersion medium, a dispersion interference-preventing agent comprising an organic acid, and powder of the heat-irreversibly coagulating glucan, and stirring the mixture to disperse the powder of the glucan into the dispersion medium, thereby preparing a slurry having an increased viscosity.

Furthermore, in the present invention, the cigarette-like article can be prepared by mixing the tobacco flavor-generating material obtained in the stage (d) with a sheet tobacco material; forming this mixture into a sheet form; cutting or pulverizing the obtained sheet to prepare a tobacco flavor-generating medium in a form of cuts or powder; and, in the stage (f), combining the flavor-generating medium with the tobacco flavor-adjusting material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
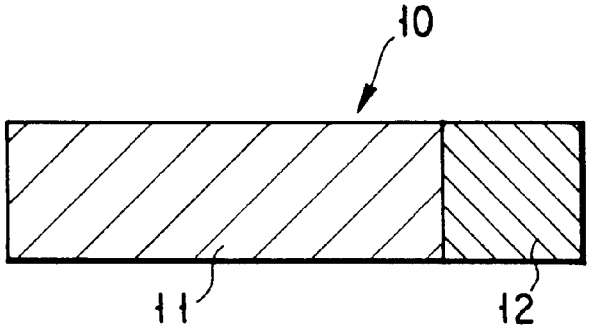
FIGS. 1 to 4 are schematic cross sectional views showing various tobacco flavor-tasting articles produced according to the present invention.

The present invention will be described in detail below.

According to the present invention, in the first stage (a), a leaf tobacco is subjected to extraction process, so as to obtain a tobacco extract liquid and a leaf tobacco fibrous residue, the residue after the extraction, which does not substantially contain any tobacco extract.

For this purpose, for example, 20 to 200 parts by weight of a leaf tobacco can be added to 1000 parts by weight of water, and then this mixture is stirred while being heated at, for example, 10 to 90° C., so as to extract a leaf tobacco extract. The resultant extract is filtered with a filter having an average pore size of from 5 to 10 μm. The leaf tobacco extract can be obtained as the filtrate, and a leaf tobacco fibrous residue can obtained as the filtration residue. The obtained aqueous leaf tobacco extract liquid may be used as it is, or may be concentrated by 1 to 70%. As the leaf tobacco extract, use may be made of a leaf tobacco extract from which nicotine is removed. The leaf tobacco extract may be dried into powder by a spray dry method.

In the next stage (b) of the present invention, an aqueous viscous dispersion containing the leaf tobacco extract together with heat-irreversibly coagulating glucan is prepared, and this dispersion is formed into a sheet form. The obtained sheet is then heated to coagulate the glucan in a state wherein the tobacco extract is incorporated within the glucan. Thus, a heat-irreversibly coagulated glucan sheet containing the tobacco extract is prepared.

The heat-irreversibly coagulating glucan used in the present invention is known per se. For example, curdlan, which is most preferably used in the present invention, is a straight chain β-1,3-glucan wherein about 400–500 D-glucose molecules are β-glucoside linked with each other at their 1–3 positions, is water-insoluble and is insoluble in almost all organic solvents. Further, glucan is safe for the human body. Such glucan is commercially available in powder form.

A first procedure for preparing the highly viscous aqueous dispersion containing the leaf tobacco extract together with the heat-irreversibly coagulating glucan follows the method disclosed in International Publication PCT WO95/20330 or PCT WO95/20329. Namely, according to the first procedure, glucan in powder form is first stirred at a high speed in water as a dispersion medium to obtain a high viscosity dispersion (glucan slurry). This dispersion is preferably prepared by stirring with a mixer at a temperature from 20 to 30° C. This results in a stable dispersion of glucan in water. When an amount of heat-irreversibly coagulating glucan such as curdlan is too large, then the viscosity of the resultant slurry tends to be too high, making it difficult to form a slurry which can be readily handled. Therefore, the concentration in water of the heat-irreversibly coagulating glucan, in particular curdlan, is preferably from 1 to 20% and more preferably from 3 to 5% by weight.

The leaf tobacco extract or concentrate thereof is mixed into the obtained dispersion of glucan in water, and then the mixture is stirred under the same stirring conditions as above to obtain an aqueous dispersion containing the leaf tobacco extract together with glucan and having a high viscosity (for example, 4,000–8,000 mPa·s at 25° C.). The leaf tobacco extract can be mixed in a powder form into the dispersion of glucan in water.

In order to obtain a dispersion of heat-irreversibly coagulating glucan containing a larger amount of the leaf tobacco extract, the leaf tobacco extract or a concentrate thereof may possibly be used as a dispersion medium, instead of water, in preparing the high viscosity aqueous dispersion. However, it has been found that even if glucan powder is to be dispersed as it is into a large amount of the leaf tobacco extract, the dispersion of the glucan powder into the leaf tobacco extract and gelation of the obtained dispersion are inhibited by hydrophilic materials dissolved in the leaf tobacco extract, hydrophobic materials present in a form of oils or solids which are not dissolved in the extract, fibrous dusts present as fine particles in the extract, and similar materials. When the dispersion of glucan is inhibited, the viscosity of the slurry is not increased sufficiently, resulting in flowing-out of the slurry, casting-failure or scattering of the slurry in the stage of forming a sheet, and further resulting in reduction in gel strength in a subsequent thermal gelation step, causing the inhibition of the gel formation. When the formation of the gel is inhibited, properties of the sheet such as strength remarkably deteriorate and a suitable sheet formation becomes difficult. In addition, the effect of including the leaf tobacco extract within the glucan gel is decreased, and stability of holding the leaf tobacco extract and duration properties of releasing the leaf tobacco extract are remarkably deteriorated.

To overcome these problems, the present inventors have conducted extensive studies to find that the dispersion interference can be prevented if at least one organic acid is added in dispersing powder of glucan into the leaf tobacco extract (or concentrate thereof) as a dispersion medium for glucan, making it possible to produce a heat-irreversibly coagulated glucan sheet holding the leaf tobacco extract at a high content and with good stability and having a satisfactory strength.

In other words, a second and more preferable procedure for preparing the high viscosity aqueous dispersion containing the leaf tobacco extract and the heat-irreversibly coagulating glucan comprises preparing a mixture containing the aqueous leaf tobacco extract or a concentrate thereof as a dispersion medium, a dispersion interference-preventing agent comprising an organic acid, and powder of the heat-irreversibly coagulating glucan; and stirring the prepared mixture to disperse the glucan powder into the dispersion medium (the leaf tobacco extract or the concentrate thereof), whereby a slurry having an increased viscosity can be obtained.

The dispersion interference-preventing agent used in the second procedure for preparing the high viscosity dispersion preferably comprises a carboxylic acid. Among carboxylic acids, malic acid, citric acid, tartaric acid, succinic acid, lactic acid and mixtures thereof are particularly preferable in that they do not have any bad influence on the aroma and flavor of the leaf tobacco extract and they exhibit higher effect of preventing the dispersion interference.

The organic acid is added preferably in an amount of 30% by weight or less, more preferably 1–10% by weight of the leaf tobacco extract or the concentrate thereof.

The order of addition of the dispersion interference-preventing agent comprising an organic acid and the glucan is not particularly limited. Either one of them may be first added. Alternatively, they may be added at the same time.

The mixture thus obtained is stirred at a high speed to disperse the glucan into the aqueous leaf tobacco extract or a concentrate thereof. Thus, a slurry having an increased viscosity (for example, 4,000–8,000 mPa·s at 25° C.) is obtained. Preferably, this slurry preparation is carried out using a mixer and at a temperature of 20–30° C. as in the first procedure. The concentration of the heat-irreversibly coagulating glucan, in particular curdlan, is preferably from 1 to 20% and more preferably from 3 to 5% by weight of the leaf tobacco extract or a concentrate thereof for the same reasons as in the first procedure.

Incidentally, it has been found that in order to hold the leaf tobacco extract within the heat-irreversibly coagulated glucan sheet more stably or in a larger amount, it is preferable to prepare a dissolved mater in which an emulsifier, preferably that known as a food additive, such as glycerin fatty acid ester, sucrose fatty acid ester, sorbitan fatty acid ester, propyleneglycol fatty acid ester, or lecithin, is dissolved in an oily solvent such as any vegetable oil or saturated fatty acid triglyceride, and provide this dissolved matter in the mixture or dispersion containing the glucan, prepared by the aforementioned first or second procedure. It is particularly preferred to use, as an oily solvent, a middle chain saturated fatty acid triglyceride (MCT), which can dissolve almost all of the hydrophobic components in the leaf tobacco extract, has very high stability against oxidization since it does not contain an unsaturated fatty acid, and can be easily handled because of its low viscosity. The emulsifier, if used, allows for the production of a preferable emulsion having the leaf tobacco extraction component uniformly dispersed and held therein.

To impart flexibility to the heat-irreversibly coagulated glucan sheet to be obtained so that the sheet can be easily stripped or pealed from a support, it is also preferred to add, to the aqueous glucan dispersion prepared by the first or second procedure, a softening agent comprising a polyhydric alcohol (for example, glycerin, propylene glycol and the like) and/or a saccharide (for example, a monosaccharide such as glucose or fructose; a disaccharide such as maltose, saccharose or lactose; a polysaccharide such as cellulose or starch; an oxidized derivative thereof such as aldonic acid or uronic acid; and a sugar alcohol such as sorbitol). It is possible to adjust the flexibility of the obtained heat-irreversibly coagulated glucan sheet by adjusting the ratio of the polyhydric alcohol and saccharide used.

After the high viscosity aqueous glucan dispersion (glucan slurry) containing the leaf tobacco extract and other components has been prepared as above, this aqueous glucan dispersion is optionally subjected to a defoaming treatment under a reduced pressure and is cast into a thin sheet onto a suitable support (for example, a stainless belt). The resultant cast sheet is heated and dried at such a temperature that the glucan is heat-irreversibly coagulated/gelled (at a temperature of from 80 to 140° C., for example, for curdlan), whereby water is removed off to, for example, 10% of the total weight and the glucan is heat-irreversibly coagulated/gelled in a state wherein the glucan firmly fix and hold the leaf tobacco extract therein. Thus, a heat-irreversibly coagulated glucan sheet (glucan gel sheet) can be obtained. This gelation is effected only by heating, without any gelling agent being used. The obtained glucan gel sheet is thermally stable. Even if it is heated again, the sheet is not melted.

The glucan gel sheet holding the leaf tobacco extract therein, obtained as above, can be easily stripped from the support. If necessary, the glucan gel sheet may be humidified and conditioned when it is stripped.

The glucan gel sheet obtained according to the present invention has an excellent property that the leaf tobacco extract, the flavor component, is hardly released under ordinary preservation conditions (for example, 22° C. and a relative humidity of 60%), but the tobacco flavor component is emitted immediately upon burning or heating, and does not generate any unpleasant flavor or odor upon burning or heating. The glucan gel sheet obtained according to the present invention is insoluble in water and is hardly dissolved in almost all organic solvents. The glucan gel sheet prepared according to the second procedure can contain up to 90% by weight of the leaf tobacco extract, although the glucan gel sheet according to the first procedure can contain at most 20% by weight of the leaf tobacco extract.

Preferably, amounts of the respective components in the final glucan gel sheet are, on dry weight basis, as follows.

Preferably, glucan, in particular curdlan, is incorporated into the final glucan gel sheet in an amount of 2 to 70% by weight. If the amount of glucan is more than 70% by weight, the flexibility of the resultant gel dents to deteriorate. If the amount of glucan is less than 2% by weight, the gel formation is liable to be incomplete. More preferably, glucan is incorporated into the final glucan gel sheet in an amount of 10 to 40% by weight.

Preferably, the oily solvent is incorporated into the final glucan gel sheet in an amount of 30% by weight or less. If the amount is more than 30% by weight, the oily solvent tends not to be included within the resultant glucan gel so that the solvent is liable to be leaked to the outside of the glucan gel. More preferably, the oily solvent is incorporated into the final glucan gel sheet in an amount of 5 to 15% by weight in the first procedure, and in an amount of 3 to 15% by weight in the second procedure.

Preferably, the emulsifier is incorporated into the final glucan gel sheet in an amount of 30% by weight or less. If the amount is more than 30% by weight, the emulsifier tends not to be included within the gel so that the emulsifier is liable to be leaked to the outside of glucan gel, as in the case of the oily solvent. Therefore, it is preferable that the total amount of the oily solvent and the emulsifier be 30% by weight or less. The ratio of the oily solvent to the emulsifier is optimally 2 to 1. More preferably, the amount of the emulsifier is 5 to 15% by weight in the first procedure, and is 2 to 15% by weight in the second procedure.

The polyhydric alcohol and the saccharide are incorporated into the final glucan sheet, preferably in an amount of 50% by weight or less in total. A more preferable total amount is 10 to 30% by weight in the first procedure, and is 5 to 30% by weight in the second procedure.

The glucan gel sheet thus obtained is cut or pulverized to obtain a tobacco flavor-generating material in a form of cuts or powder (stage (d)).

On the other hand, the fibrous residue, which is the leaf tobacco extraction residue, is suitably processed if desired, and then is formed into a sheet to prepare a fibrous sheet which does not substantially contain any tobacco extract (stage (c)).

The leaf tobacco fibrous residue is usually dispersed in water and subjected to refining treatment with a refiner. To the aqueous dispersion containing the refined leaf tobacco fibrous residue, a binder such as carboxymethylcellulose and, optionally, a humectant such as glycerin are added, and the mixture is sufficiently mixed to obtain a slurry. This slurry is cast onto a suitable support, such as a stainless steel belt, and then is heated and dried to prepare a leaf tobacco fibrous sheet. Alternatively, to the aqueous dispersion containing the refined leaf tobacco fibrous residue, a reinforcing material such as pulp is added, without the binder being added, and the mixture can be paper-machine made to prepare a leaf tobacco fibrous sheet. Still alternatively, a leaf tobacco fibrous sheet can be obtained as a so-called slurry sheet.

The leaf tobacco fibrous sheet thus obtained is cut so as to obtain a tobacco flavor-adjusting material consisting of the leaf tobacco fibrous cuts (stage (e)).

Finally, the aforementioned tobacco flavor-generating material and the tobacco flavor-adjusting material are combined in a desired ratio such that desired tobacco flavor can be obtained in a final tobacco flavor-tasting article, thereby preparing a cigarette-like article (stage (f)).

The tobacco flavor-tasting article obtained from the combination of the tobacco flavor-generating material and the tobacco flavor-adjusting material according to the present invention may be a burning type smoking article from which tobacco flavor can be tasted upon burning. Alternatively, the tobacco flavor-tasting article according to the present invention may be of a non-burning type without being accompanied with burning smell of tobacco leaves, as disclosed in International Publication PCT WO95/20329.

This non-burning type article comprises a flavor-generating medium containing a flavor-generating material which can emit or release a sufficient amount of flavor component only upon heating, and a heating source which is provided physically separate from this flavor-generating medium and which is used to heat the flavor-generating medium to cause the flavor-generating medium to release the flavor component therefrom.

Now, some embodiments wherein the tobacco flavor-generating material and the tobacco flavor-adjusting material according to the present invention are combined will be schematically described with reference to FIGS. 1 to 4. Throughout FIGS. 1 to 4, the same reference numbers denote the same or similar members.

FIG. 1 illustrates a burning type smoking article 10 obtained by blending the tobacco flavor-generating material and tobacco flavor-adjusting material according to the present invention uniformly in a desired ratio and wrapping this blend 11 used as a burnable smoking material by a conventional cigarette paper (not shown) to provide a cigarette-like article. This burning type smoking article 10 may be fitted with a conventional filter 12 for a cigarette.

Figure 2:
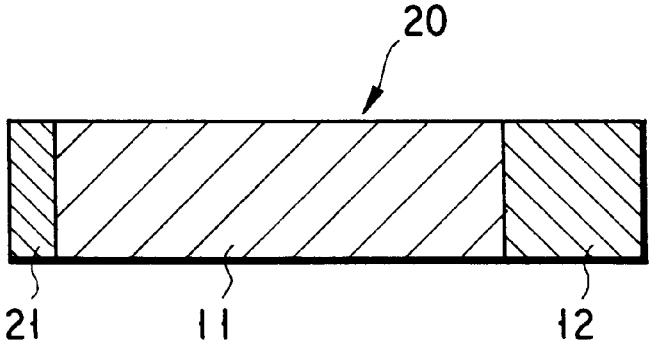

FIG. 2 illustrates a non-burning type article 20 comprising the same blend 11 wrapped by a suitable heat-resistance sheet material (not shown) in the same manner, and a heating source 21 attached to one end of the blend 11 and having an air flow passageway (not shown) therein.

Figure 3:
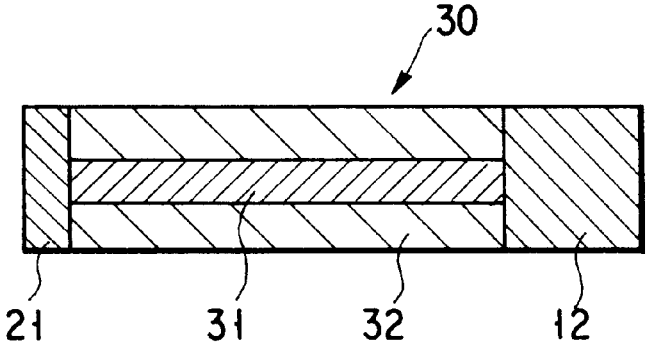

FIG. 3 illustrates a non-burning type tobacco flavor-tasting article 30 wherein a tobacco flavor-generating material 31 according to the present invention constitutes only a central section (a central tobacco flavor-generating material section) in its axial direction, and a tobacco flavor-adjusting material 32 according to the present invention (an outside tobacco flavor-adjusting material section) is arranged to surround the central section.

Figure 4:
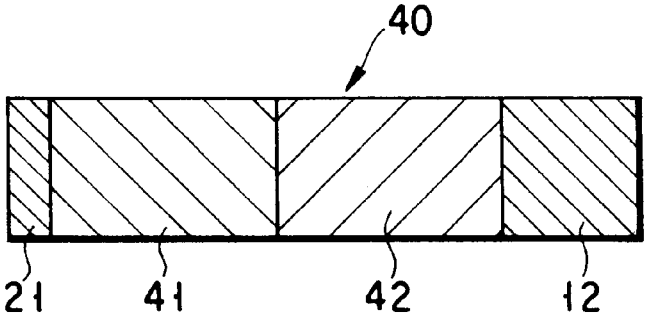

FIG. 4 illustrates a non-burning type tobacco flavor-tasting article 40 wherein a tobacco flavor-generating material 41 and a tobacco flavor-adjusting material 42 according to the present invention are separately sectionalized and then combined back and forth in their axial direction. A heating source 21 is disposed at the tip of the section of the tobacco flavor-generating material 41.

As describe above, according to the present invention, the tobacco flavor-adjusting material can be used to disperse the tobacco flavor-generating material uniformly into the tobacco flavor-tasting article (blend of the both), or to localize the tobacco flavor-generating material into the tobacco flavor-tasting article (sectionalization); therefore, flexibility of design of the tobacco flavor-tasting article dependent on desired tobacco flavor is enhanced.

Incidentally, in the tobacco flavor-tasting articles descried referring to FIGS. 1 to 4, the tobacco flavor-generating material according to the present invention is used as it is. In the present invention, however, the tobacco flavor-generating material according to the present invention can be preferably kneaded into conventional sheet tobacco materials, the kneaded material can be formed into a sheet, which can then be cut, or pulverized by a hammer mill, to prepare a tobacco flavor-generating medium in a form of powder or cuts. An example of a typical composition of a rolled sheet tobacco raw material containing the tobacco flavor-generating material according to the present invention is 100 parts by weight of tobacco powder (or cellulose or dolomite), 5 to 20 parts by weight of a reinforcing material (such as tobacco fibers or pulp), 1 to 15 parts by weight of a binder (such as carboxymethylcellulose), 1 to 40 parts by weight (preferably from 5 to 20 parts by weight) of the tobacco flavor-generating material according to the present invention, a necessary amount of water. The composition may optionally contain suitable amounts of optional components, for example, a humectant agent (such as glycerin) and a conventional water-resistance agent. The tobacco flavor-generating material comprising cuts or powder of glucan gel sheet according to the present invention may be kneaded into other sheet tobacco such as a slurry sheet tobacco and a paper machine-made sheet tobacco. The flavor-generating medium thus obtained can be used, instead of the aforementioned tobacco flavor-generating material itself, in combination with the tobacco flavor-adjusting material of the invention to prepare a tobacco flavor-tasting article in the same manner as above.

Figure 5:
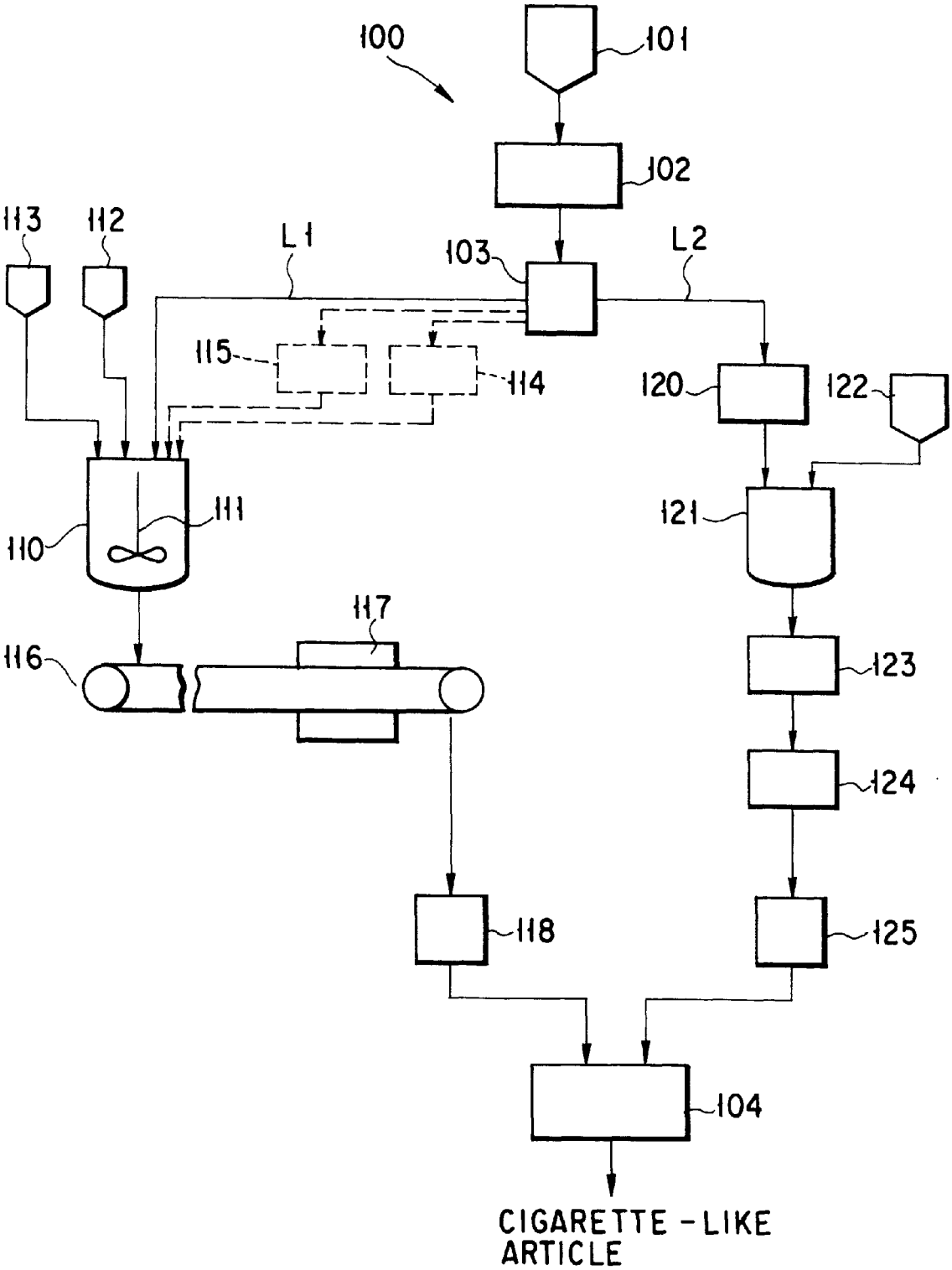
FIG. 5 is a block diagram illustrating an example of a plant disposed on one site, for continuously carrying out the method of the present invention.

The method of the present invention can be appropriately carried out in a continuous production plant in the same site. One embodiment of such a plant is shown in FIG. 5. To carry out the stage (a), this plant 100 has a leaf tobacco extractor 102 for effecting an extraction treatment on a leaf tobacco from a hopper 101, and a filtering device 103 disposed at the downstream side of this extractor 102. From the filtering device 103, first and second production lines L1 and L2 are branched; the first production line L1 is a line along which a glucan gel sheet is prepared using a leaf tobacco extract obtained as a filtrate from the filtering device 103, and the second line L2 is a line along which a leaf tobacco fibrous sheet is prepared using a leaf tobacco fibrous residue obtained as a filtration residue.

In the first production line L1 and downstream of the filtering device 103, a mixing container 110 with a high speed stirrer 111 is arranged for preparing a high viscosity aqueous glucan dispersion using the leaf tobacco extract from the filtering device 103. This mixing container 110 has an inlet port for introducing the leaf tobacco extract from the filtering device 103, a supply port for supplying the glucan powder from a glucan powder container 112, and another supply port for supplying other additives from the other additive container 113. A concentrate of the leaf tobacco extract may be supplied from the filtering device 103 to the mixing container 110 through a concentrator 114, or the powder of the leaf tobacco extract may be supplied from the filtering device 103 to the mixing container 110 through a spray dryer 115.

Underneath the mixing container 110, there runs a sheet forming unit 116 which can consist of a stainless steel belt, which receives the high viscosity aqueous glucan dispersion discharged from the bottom of the mixing container 110 and allows for the formation of the dispersion into a sheet. The forming unit 116 forms the high viscosity aqueous glucan dispersion sequentially received from the mixing container 110 into a sheet form.

The stainless steel belt 116 passes through a dryer 117 for heating to dry the glucan dispersion formed into the sheet, thereby heat-irreversibly coagulate the glucan. The coagulated glucan sheet coming out of the dryer 117 is stripped from the stainless steel belt with an appropriate stripping means (not shown).

On the other hand, the leaf tobacco fibrous residue from the filtering device 103 is subjected to refining treatment within a refiner 120 disposed in the second line L2, and then is fed to a leaf tobacco fibrous sheet producing unit. This leaf tobacco fibrous sheet producing unit has a second mixing container 121 for receiving the leaf tobacco fibrous mixture refined in the refiner 120, receiving predetermined additives from the additive container 122 dependently on a form of the leaf tobacco fibrous sheet (a rolled sheet, paper machine-made sheet or slurry sheet), and mixing them. The forming mixture discharged from the mixing container 121 is formed into a sheet by an appropriate sheet-forming unit 123 dependent on a form of a sheet to be obtained (for example, at least one pair of rollers in case of the rolled sheet). The formed sheet passes through the drier 124 where it is dried.

The obtained glucan gel sheet and leaf tobacco fibrous sheet are cut into suitable sizes, respectively, by means of respective appropriate cutters 118 and 125. Thereafter, in a tobacco producing unit 104, both the cuts are mixed in a desired ratio in a suitable mixer (not shown). The mixed cuts or blend is used as a blend cut to produce a cigarette-like article in a conventional cigarette-making machine. Alternatively, in the tobacco producing unit 104, the respective cuts can be sectionalized (into the tobacco flavor-generating material section and the tobacco flavor-adjusting material section) in the manner as described above, and then the respective sections are connected to produce a cigarette-like article.

The present invention will be described below by way of Examples.

EXAMPLE 1

100 g of a flue cured leaf tobacco were added into 1000 g of water, and was stirred at a stirring rotation speed of 450 rpm for 30 minutes while being heated at 50° C. to extract a tobacco extract. The mixture was then filtered to give a desired aqueous leaf tobacco extract, and a leaf tobacco fibrous residue (the extraction residue).

To the entire amount (710 g) of the aqueous leaf tobacco extract, 28 g of powder of curdlan and 5.5 g of a malic acid were added, together with a solution (10.5 g) of 3.5 grams of lecithin dissolved in 7 g of MCT. This mixture was stirred at a stirring rotation speed of 3000 rpm while being kept at a temperature of 25° C., so as to emulsify/disperse the curdlan into the aqueous leaf tobacco extract. To the obtained emulsified/dispersed material, 7 g of glycerin and 7 g of sorbitol were added and then stirred under the same stirring condition to obtain a curdlan slurry having an increased viscosity(5900 mPa·s at 25° C.).

This curdlan slurry was cast into a sheet onto a stainless steel belt, and then gelled and dried at 110° C. The sheet was stripped from the belt to give 90 g of a desired curdlan gel sheet. The curdlan gel sheet was found to incorporate 40% by weight of the leaf tobacco extract fixed and held therein. This curdlan gel sheet was cut into sizes of 50×50 mm.

On the other hand, the entire amount (328 g)of the leaf tobacco fibrous residue was added into 1200 g of water, and refined with a refiner. Into the obtained fibrous residue dispersion, 8.5 g of CMC and 8.5 g of glycerin were added, and the mixture was stirred to prepare a slurry. This slurry was cast into a sheet on a stainless steel belt, dried at 110° C., and stripped from the belt to give 97 g of a desired leaf tobacco fibrous sheet. This leaf tobacco fibrous sheet was cut into sizes of 50×50 mm.

The entire amounts of the cuts of the aforementioned curdlan gel sheet and the cuts of the leaf tobacco fibrous sheet were mixed and cut to obtain cuts. These cuts were wrapped by a conventional cigarette paper as a rod to produce a cigarette-like article.

EXAMPLE 2

10 g of a flue cured leaf tobacco were extracted under the same conditions as in Example 1, and filtered to give a leaf tobacco extract and a leaf tobacco fibrous residue. The entire amount of the obtained leaf tobacco extract was dried by a spray dry method to give powder of the leaf tobacco extract.

28 g of curdlan and a solution of 3.5 g of lecithin dissolved in 7 g of MCT were added to 700 g of water, and then emulsified/dispersed under the same stirring conditions as Example 1. The entire amount (32 g) of the powder of the leaf tobacco extract, 7 g of glycerin and 7 g of sorbitol were added to the obtained emulsified/dispersed material and then stirred under the same conditions to obtain a curdlan slurry. Using this curdlan slurry, the same procedures as in Example 1 were followed to prepare a curdlan gel sheet, which was cut into sizes of 50 mm×50 mm.

On the other hand, using the entire amount of the leaf tobacco fibrous residue, the same procedures as in Example 1 were followed to prepare a leaf tobacco fibrous sheet. This leaf tobacco fibrous sheet was cut into sizes of 50×50 mm.

The entire amounts of the cuts of the aforementioned curdlan sheet and the cuts of the leaf tobacco fibrous sheet were mixed and cut to give cuts. These cuts were wrapped by a conventional cigarette paper as a rod to produce a cigarette-like article.

COMPARATIVE EXAMPLE 1

10 kg of a flue cured leaf tobacco were pulverized by a mill to give powder of the tobacco. To the powder of tobacco, 3 Kg of α-cellulose and 3 Kg of curdlan were added, and the mixture was stirred sufficiently to prepare a powdery mixture. To this powdery mixture, 0.5 Kg of propylene glycol, 0.5 kg of sucrose and 13 Kg of water were added and then mixed sufficiently to prepare a uniform wet mass. This wet mass was supplied between rolls (surface temperature: 150° C.) in a thermal rolling machine the surface temperature of which was 150° C., and then an obtained thin film was stripped, dried and conditioned to give a rolled sheet. This sheet was cut to yield cuts. These cuts were wrapped as a rod by a conventional cigarette paper to produce a cigarette-like article.

<Organoleptic Evaluation Test>

The cigarette-like articles produced in Examples 1 and 2, and Comparative Example 1 were lighted and smoked. The flavor of the cigarette-like articles of Examples 1 and 2 were evaluated, with the article of Comparative Example 1 used as a reference, according to the following 3-stage criteria by 10 organoleptic examiners.

E: 8 or more examiners who judged that the cigarette-like articles were superior to the cigarette of Comparative Example 1.

G: 5–7 examiners who judged that the cigarette-like articles were superior to the cigarette of Comparative Example.

B: Less than 5 examiners who judged that the cigarette-like articles were superior to the cigarette of Comparative Example Results of this test are shown Table 1 below.

<Organoleptic Evaluation Test after Preservation>

The cigarette-like article of Example 1 and Comparative Example 1 were preserved at a temperature of 35° C. and a relative humidity of 75% for 30 days. With the flavor and taste of the respective cigarettes at the time of starting the preservation used as references, the flavor and taste of the respective cigarettes after the preservation were evaluated according to the following 3-stage criteria by 10 organoleptic examiners.

ND: No deterioration was recognized.

SD: Slight deterioration was recognized.

CD: Considerable deterioration was recognized.

Obtained results for these test are shown in Table 2 below.

TABLE 1

| Organoleptic Evaluation Test | | |
|---|---|---|
| Cigarette | Flavor | Taste |
| Example 1 | E | E |
| Example 2 | E | E |

TABLE 2

| Organoleptic Evaluation Test after Preservation | | |
|---|---|---|
| Cigarette | Flavor | Taste |
| Example 1 | ND | ND |
| Comparative Example 1 | CD | CD |

As has been described above, according to the present invention, there is provided a method for producing a tobacco flavor-tasting article, by utilizing a tobacco flavor-generating material, other than tobacco materials, having a leaf tobacco extract stably fixed and held therein, and also effectively utilizing a leaf tobacco fibrous residue as a leaf tobacco extraction residue. According to this method, starting from extraction treatment of the leaf tobacco, the tobacco flavor-generating material and the tobacco flavor-adjusting material can be prepared from the leaf tobacco extract and the leaf tobacco fibers as an extraction residue, respectively, and they can be combined so that a tobacco flavor-tasting article can be manufactured with an increased flexibility in design of flavor and taste. According to the present invention, such a tobacco flavor-tasting article can be produced continuously in one plant in the same site.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for producing a tobacco flavor-tasting article comprising the stages of:

(a) subjecting a leaf tobacco to an extraction treatment to obtain a tobacco extract, and a leaf tobacco fibrous residue that does not substantially contain any tobacco extract, from the leaf tobacco;

(b) preparing a viscous aqueous dispersion that contains said tobacco extract together with a heat-irreversibly coagulating glucan, forming the dispersion into a sheet, heating the resultant sheet to coagulate said glucan in a state wherein said tobacco extract is incorporated within the glucan, thereby preparing a heat-irreversibly coagulated glucan sheet containing the tobacco extract;

(c) processing said leaf tobacco fibrous residue into a sheet, thereby preparing a leaf tobacco fibrous sheet that does not substantially contain the tobacco extract;

(d) cutting or pulverizing said heat-irreversibly coagulated glucan sheet to prepare a tobacco flavor-generating material in a form of cuts or powder;

(e) cutting said leaf tobacco fibrous sheet to prepare a tobacco flavor-adjusting material in a form of cuts; and (f) preparing a cigarette-like article by using the tobacco flavor-generating material and the tobacco flavor-adjusting material in combination.

2. The method according to claim 1, wherein, in the stage (b), the aqueous dispersion is prepared by stirring a mixture containing water as a dispersion medium, the leaf tobacco extract or a concentrate thereof, and powder of the heat-irreversibly coagulating glucan.

3. The method according to claim 2, wherein said glucan is present in water at a concentration of from 1 to 20% by weight in the stage (b).

4. The method according to claim 2, wherein a dissolved matter prepared by dissolving an emulsifier into an oily solvent is further mixed in the stage (b).

5. The method according to claim 4, wherein said oily solvent comprises a middle-chain saturated fatty acid triglyceride.

6. The method according to claim 4, wherein said oily solvent is contained in an amount of up to 30% by weight of the final glucan sheet.

7. The method according to claim 4, wherein the emulsifier is contained in an amount of up to 30% by weight of the final glucan sheet.

8. The method according to claim 2, wherein a softening agent comprising a polyhydric alcohol or a saccharide is further mixed in the stage (b).

9. The method according to claim 8, wherein said softening agent is contained in an amount of up to 50% by weight of the final glucan sheet.

10. The method according to claim 1, wherein, in the stage (b), the aqueous dispersion is prepared by preparing a mixture containing the leaf tobacco extract or a concentrate thereof as a dispersion medium, a dispersion interference-preventing agent comprising an organic acid, and powder of the heat-irreversibly coagulating glucan, and stirring the mixture to disperse the powder of the glucan into the dispersion medium.

11. The method according to claim 1, wherein said dispersion interference-preventing agent comprises an organic carboxylic acid.

12. The method according to claim 10, wherein said organic carboxylic acid is at least one carboxylic acid selected from the group consisting of malic acid, citric acid, tartaric acid, succinic acid, and lactic acid.

13. The method according to claim 10, wherein said organic acid is mixed in an amount of up to 30% by weight of the leaf tobacco extract.

14. The method according to claim 5, wherein said glucan is mixed in an amount of 1 to 20% by weight of the leaf tobacco extract.

15. The method according to claim 10, wherein a dissolved matter prepared by dissolving an emulsifier into an oily solvent is further mixed in the stage (b).

16. The method according to claim 15, wherein said oily solvent comprises a middle-chain saturated fatty acid triglyceride.

17. The method according to claim 15, wherein said oily solvent is contained in an amount of up to 30% by weight of the final glucan sheet.

18. The method according to claim 15, wherein said emulsifier is contained in an amount of up to 30% by weight of the final glucan sheet.

19. The method according to claim 10, wherein a softening agent comprising a polyhydric alcohol or a saccharide is further mixed in the stage (b).

20. The method according to claim 8, wherein said softening agent is contained in an amount of up to 50% by weight of the final glucan sheet.

21. The method according to claim 1, wherein the tobacco flavor-generating material obtained in the stage (d) is mixed with sheet tobacco materials; the resultant mixture is formed into a sheet; the resultant sheet is cut or pulverized to prepare a tobacco flavor-generating medium in a form of cuts or powder; and the tobacco flavor-generating medium is used, in the stage (f), in combination with said tobacco flavor-adjusting material to prepare a cigarette-like article.

22. The method according to claim 1, which is carried out in one continuous production plant.

* * * * *